US005154635A

United States Patent [19]

Kaufman et al.

[11] Patent Number: 5,154,635

[45] Date of Patent: Oct. 13, 1992

[54] COAXIAL VACUUM CABLE

[76] Inventors: Harold R. Kaufman, 5920 Obenchain Rd., Laporte, Colo. 80535; Raymond S. Robinson, 2612 Bradbury Ct., Fort Collins, Colo. 80521

[21] Appl. No.: 803,713

[22] Filed: Dec. 4, 1991

Related U.S. Application Data

[63] Continuation of Ser. No. 576,078, Aug. 31, 1990, abandoned.

[51] Int. Cl.[5] ..... H01R 17/04

[52] U.S. Cl. ..... 439/578; 174/28; 174/111

[58] Field of Search ..... 439/578-585, 439/610, 851, 98; 174/28, 111

[56] References Cited

U.S. PATENT DOCUMENTS

| | | | |
|---|---|---|---|
| 1,667,510 | 4/1928 | Coe | 174/28 |
| 2,217,162 | 10/1940 | Ducati | 174/28 |
| 2,548,457 | 4/1951 | Wilson | 439/583 |
| 2,587,916 | 3/1952 | Squies | 174/111 |
| 4,441,781 | 4/1984 | Forney, Jr. et al. | 439/584 |
| 4,561,716 | 12/1985 | Acke | 439/578 |
| 4,619,496 | 10/1986 | Forney, Jr. et al. | 439/585 |
| 4,781,622 | 11/1988 | Ratchford et al. | 439/585 |
| 4,904,206 | 2/1990 | Laudig et al. | 439/578 |
| 4,925,403 | 5/1990 | Zoszy | 439/578 |
| 5,074,809 | 12/1991 | Rousseau | 439/578 |

FOREIGN PATENT DOCUMENTS

| | | | |
|---|---|---|---|
| 3306436 | 8/1984 | Fed. Rep. of Germany | 439/585 |

OTHER PUBLICATIONS

H. R. Kaufman and R. S. Robinson, "Ion Source Design for Industrial Applications", *AIAAJ.*, vol. 20, pp. 745-760, Jun. 1982.

Ceramaseal, "Ceramic to Metal Component Catalog", 1987, pp. M-1-M-6.

Knole, Ollendorff, and Rompe, "Gasentladungstabellan", 1935, p. 84.

vonEngle, "Ionized Gases", 1965, p. 195.

*Primary Examiner*—Larry I. Schwartz
*Assistant Examiner*—Kevin J. Carroll
*Attorney, Agent, or Firm*—Hugh H. Drake

[57] ABSTRACT

A coaxial cable has a plurality of insulated beads threaded onto an inner conductor and individually having an exterior shape such that a gap exits between each adjacent pair of beads with the gap increasing in width radially. A conductive flexible braid ensleeves the beads with that braid having interstices ventive of air but preclusive of the passage of plasma. An insulative covering ensleeves the braid and also is ventive of air but preclusive of passage of the plasma. A connector includes a termination having a barrel-shaped body fitting over the outer cable conductor. An outer connector element projects outward from the outer end of the body with that element having longitudinal slots that define a circumferentially-spaced series of flexible fingers. Those slots are ventive of air but have a size sufficiently small to preclude passage of a plasma. An inner electrical connector element projects outwardly from the inner cable conductor beyond the body. Finally, a mating connector fitting defines interchangeable connective elements. An overhang shadow-shields otherwise exposed slots.

11 Claims, 4 Drawing Sheets

COAXIAL VACUUM CABLE

The present application is a continuation of co-pending parent application 07/576,078, filed Aug. 31, 1990, now abandoned, and assigned to the same assignee as the present invention.

The present invention relates to cables for the transmission of electrical energy. More particularly, it pertains to the transmission of direct or alternating current in a vacuum environment where a plasma may be present. Even where a plasma is not present intentionally, it may be created as the result of an accidental electrical breakdown. Conservative design for a vacuum environment can thus require addressing the possibility that a plasma may exist.

Vacuum wiring, particularly in the presence of a plasma, is often a custom design problem. See H. R. Kaufman and R. S. Robinson, "Ion Source Design for Industrial Applications, "AIAA J., Vol. 20, pp. 745–760, June 1982. Problems arise because the vacuum cables that are presently available do not adequately vent the gasses from the enclosed volumes while, at the same time, excluding both the charged particles from the surrounding plasma and the neutral sputtered particles that frequently are found in a plasma environment. Believed to be illustrative of the state of the art in vacuum cables are those described at pages M-1 through M-6 of a "*Ceramic to Metal Component Catalog*" published by Ceramaseal, a Division of CERAMX, P.O. Box 260, New Lebanon, N.Y. 12125, under a copyright date of 1987.

The Ceramaseal approaches include a central copper conductor with a stainless steel outer braid separated from the center conductor by a series of cylindrical, close-fitting or nested alumina or steatite bead insulators. The center conductor is connected to one end of a central connecting element having a circumferentially-spaced series of fingers to fit on a pin in a mating connector. The braid is electrically coupled to an outer collar which threads onto an outer hollow boss of the mating connector.

Various other connectors are known for connecting coaxial cables which transmit radiofrequency energy. For example, the conventional N-type connector has a central pin which fits into a circularly-disposed series of fingers with that pin also being surrounded by circular-spaced fingers of an outer connector received within a female connector surface on the other piece of the assembly with the outer wall of that latter female connector being tightly threaded into the outer wall of a collar of the mating fitting assembly. While that N-type connector is designed in an effort to match impedences through the connector assembly, it also so fits together so as to ensure an outermost continuous conductive path without any provision for venting of the interior.

Typical pressures in industrial vacuum chambers range from several Pascal (several hundredths of a Torr) to less than one milliPascal ($\sim 10^{-6}$ Torr). A vacuum environment in this pressure range is able to withstand high voltages without electrical breakdown, at least over the short distances of one cm or less between conductors in coaxial cables. The gas from any enclosed volumes should be vented because higher pressures are conducive to electrical breakdowns. Poorly vented volumes of gas result from two frequent shortcomings of electrical cables. First, the cable itself is often covered with a continuous layer of polymer, so that gas can only escape from the cable ends. Second, the terminations of cables often enclose additional poorly-vented volumes when cables are connected together or connected to bulkhead fittings. Electrical cables with such design shortcomings require long outgassing times in a vacuum environment before they may be operated at high voltages (several hundred volts or more).

When breakdown voltages are plotted against the product of background pressure and the distance between electrodes, a minimum of about 200–500 volts is reached in the range of 1–10 Torr-cm. A range of 1–10 Torr-cm corresponds to 1–10 cm at a pressure of one Torr, or 1–10 m at a pressure of 0.01 Torr. This generalization for a wide range of gases is Paschen's law, and is plotted in FIG. 1 with the shaded area depicting the experimental range for a variety of gases. The original data for FIG. 1 include those taken with respect to air, $H_2$, Ar, Ne, Hg, $Co_2$, $NO_2$, and $SO_2$. See M. Knole, F. Ollendorff, and R. Rompe, "Gasentladungstabellen," Julius Springer, Berlin, 1935, P. 84 and A. von Engle, "Ionized Gases, "Oxford University Press, London, 1965, p. 195.

The breakdown voltage increases with either increases or decreases of pressure from the minimum-voltage region of 1–10 Torr-cm shown in FIG. 1. Most vacuum chambers in industrial applications operate at low enough pressures that an increase in local pressure will increase the likelihood of breakdown, or decrease the voltage at which a breakdown will take place. In the depicted low-pressure region, it is also common for breakdown to occur between electrodes that are farthest apart, a circumstance contrary to common experience at atmospheric pressure. That tendency for breakdown to occur between electrodes that are far apart is another reason why electrical shielding is required for high voltage conductors in a vacuum as well as why a limitation to one cm was previously mentioned.

Openings are normally required to vent trapped gas. However, many vacuum systems contain plasma in the form of a conducting gas composed of electrons and ions. Improper venting easily can permit a plasma to enter within an electrical cable associated with the apparatus, so that the presence of electrons and ions would tend to cause electrical breakdowns. Excluding a plasma depends on making any openings in shields equal to or smaller than the Debye distance, $$\lambda_D = 7.43 \times 10^3 \, (T_e/n_e)^{\frac{1}{2}} \qquad (1)$$

where $\lambda_D$ is the Debye length in m, $T_e$ is the electron temperature in eV, and $n_e$ is the electron density in no/m$^3$. For an electron density of $10^{15}$ m$^{-3}$ and a typical electron temperature of 1 eV, the Debye length is about $\frac{1}{4}$ mm. Consequently, a grounded shield to exclude a plasma with those values of electron density and temperature requires openings in the shield which are equal to or less than about $\frac{1}{4}$ mm.

Sputtering is often involved when plasmas are present. Sputtered neutral particles (usually atoms) can therefore be present to coat and degrade insulators. If radiofrequency energy is being used so that the skin effect is pronounced, sputtered particles can also degrade the conducting properties of conductor surfaces. To avoid the adverse effects of sputtered particles, the insulator and conductor surfaces should be shadow-shielded from such particles. Because the neutral particles follow straight line trajectories, insulators thus should not be "seen" by sources of sputtered particles.

As mentioned earlier, a plasma is often generated as the result of an accidental electrical breakdown. For complicated installations then, conservative design requires design for a plasma environment to limit the damage due to an accidental breakdown, even though no plasma is normally present.

Practical solutions to carrying high voltages in a vacuum environment have frequently involved covering wires with ceramic beads, often of an overlapping type called "fish spine beads". If additional shielding is required, a covering of ceramic or fiberglass material may be used over the ceramic beads. One type of commercial vacuum cable uses a woven metal braid over ceramic beads as shown in the Ceramaseal catalog mentioned above. That commercial cable uses screw-on connectors that are very poor for venting gas trapped at the cable terminations. While that approach has been effective to some degree in certain applications, better solutions are needed for many other applications.

Accordingly, it is the general object of the present invention to provide a new and improved vacuum cable which overcomes deficiencies and problems heretofore discussed.

Another object of the present invention is to provide a new and improved coaxial vacuum cable wherein any surrounding plasma is excluded from entering within the cable.

A further object of the present invention is to provide a new and improved vacuum cable wherein adverse effects from sputtered particles are eliminated or at least substantially reduced.

A more detailed objective of the present invention is to minimize adverse effects from sputtered particles by shadow shielding insulator and conductor surfaces from sources of sputtered particles.

A still further object of the present invention is to provide a coaxial vacuum cable employing as a principal dielectric material a form of successive insulating beads which promotes flexibility of the cable at the same time as gases which otherwise would be trapped are permitted to escape.

Still another aspect of the present invention is to employ an insulating bead shape in which one or both facing surfaces are convex, conical or concave so as to provide an inter-gap spacing which increases from the inner to the outer conductor in a coaxial cable.

One more object of the present invention is to provide a new and improved coaxial vacuum cable in which connector elements permit moderate variations and tolerances and afford flexibility while permitting the escape of gases that would otherwise be trapped in an enclosed volume while at the same time excluding any surrounding plasma.

In accordance with one aspect of the present invention, at least an outer one of two mating connector elements includes a circumferentially-spaced array of fingers individually separated one from the next by slots or gaps that are equal to or less than the Debye length in the plasma.

In accordance with the one aspect of the present flexible electrically-conductive inner wire. Slidably mounted on that wire are a plurality of electrically-insulative beads located successively in series along the wire. Each of the beads individually has an exterior shape such that, when so mounted, a gap exists between each adjacent pair of the beads with that gap increasing in width in the direction radially outward from inner conductor. Ensleeving the plurality of beads is an electrically-conductive flexible braid with that braid being ventive of enclosed gas but having apertures of a size sufficiently small to preclude passage of a plasma. An electrically-insulative flexible covering preferably ensleeves the braid with it having gas ventive openings of a size sufficiently small also to preclude passage of a plasma.

A related aspect of the present invention is directed to a connector assembly for such a coaxial cable that has inner and outer conductors separated by an insulating spacer. Included is an electrical termination having a barrel-shaped body open at one end to fit over an end portion of the cable and be electrically and mechanically connected to the outer conductor of the cable. An outer cylindrical hollow electrical connector element projects axially outwardly fixedly from the body with that element having longitudinal slots that define a circumferentially-spaced series of flexible fingers with the slots being ventive of gas but of a size sufficiently small to preclude the passage of plasma. An inner electrical connector element is connectable to the inner cable conductor and projects outwardly beyond the body. A mating connective fitting defines an interiorly located circumferential seat receptive of the connector element fingers, and there also is a connective element spaced inwardly within that seat and electrically interengageable with the inner connector element of the termination. Most desirably, a cylindrical overhang projects axially beyond one of the body and the fitting in a position to radially overlie but be spaced from the entirety of the slots exposed outside of the circumferential seat with that overhang axially spaced from the other end of the body and the fitting sufficiently to vent gas.

The features of the present invention which are believed to be patentable are set forth with particularity in the appended claims. The organization and manner of operation of one specific embodiment of the present invention, together with further objects and advantages thereof as well as various alternatives, may best be understood by reference to the following description taken in connection with the accompanying drawings, in the several figures of which like reference numerals identify like elements and in which:

Figure 1:
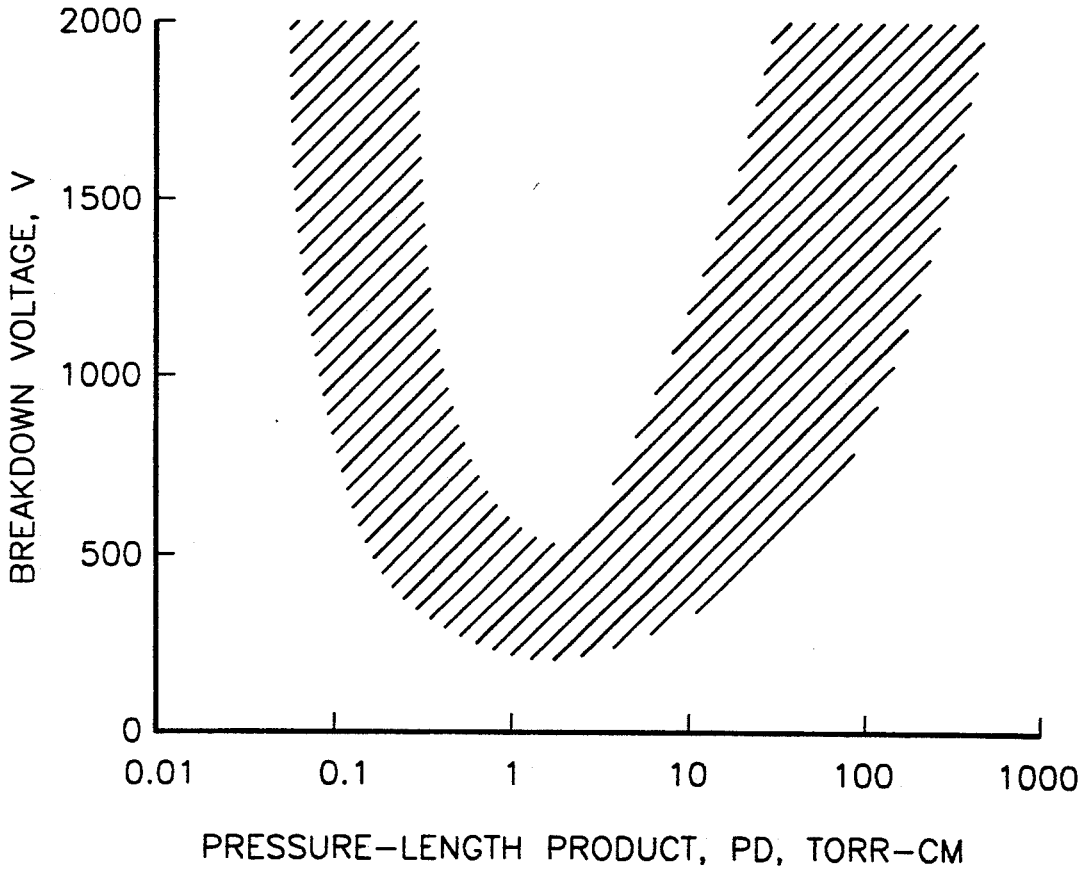
FIG. 1 is a graph useful in understanding a phenomenon addressed by the present invention.
Figure 2:
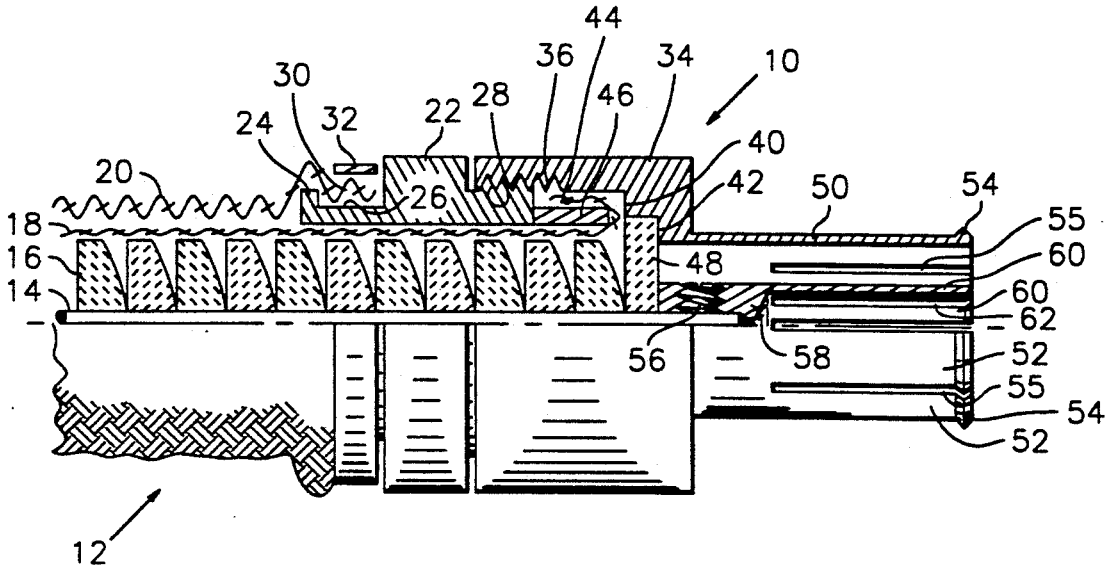
FIG. 2 is a side elevational view, partially broken away, of a cable termination of a coaxial vacuum cable.
Figure 2A:
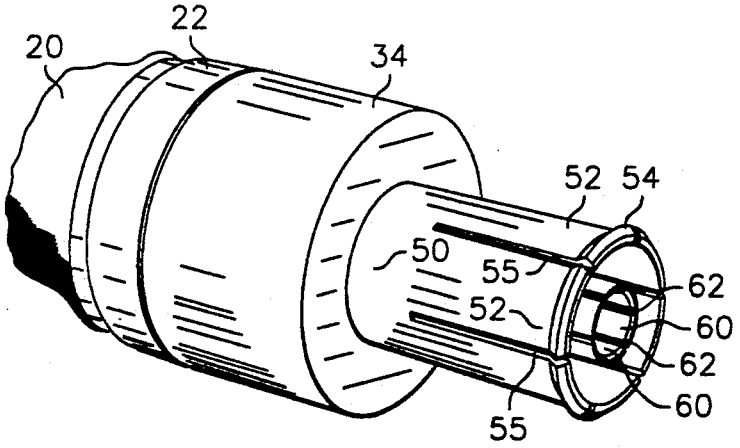
Figure 3:
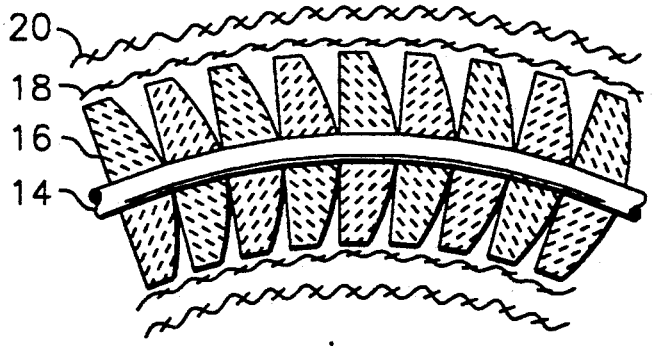
Figure 4:
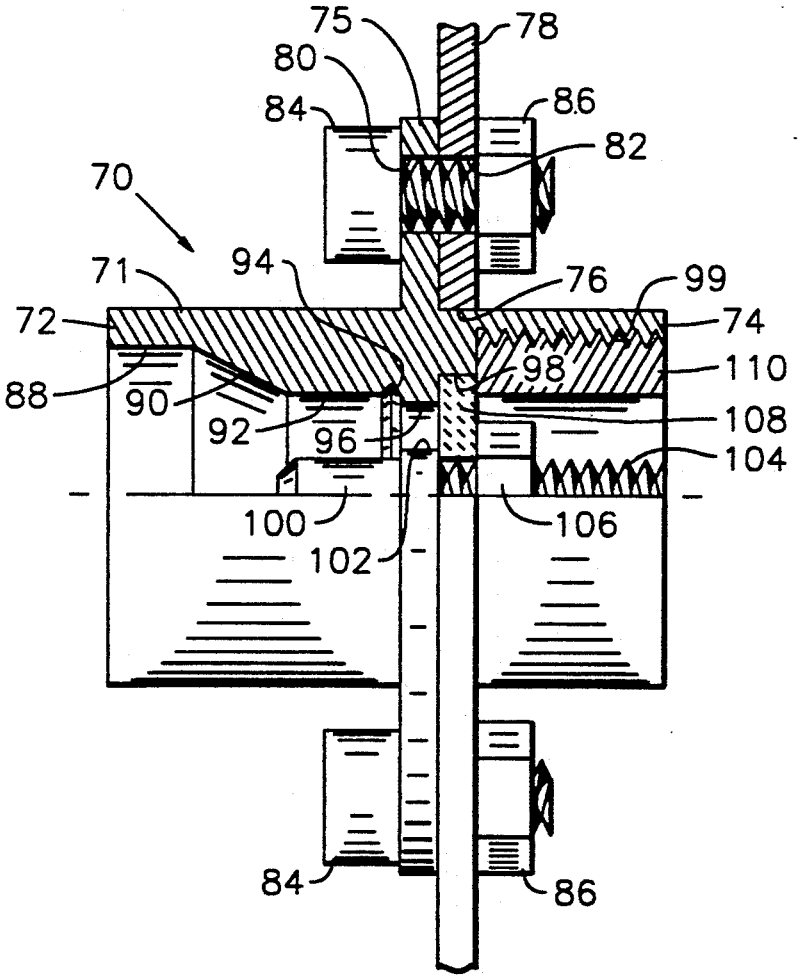
Figure 5:
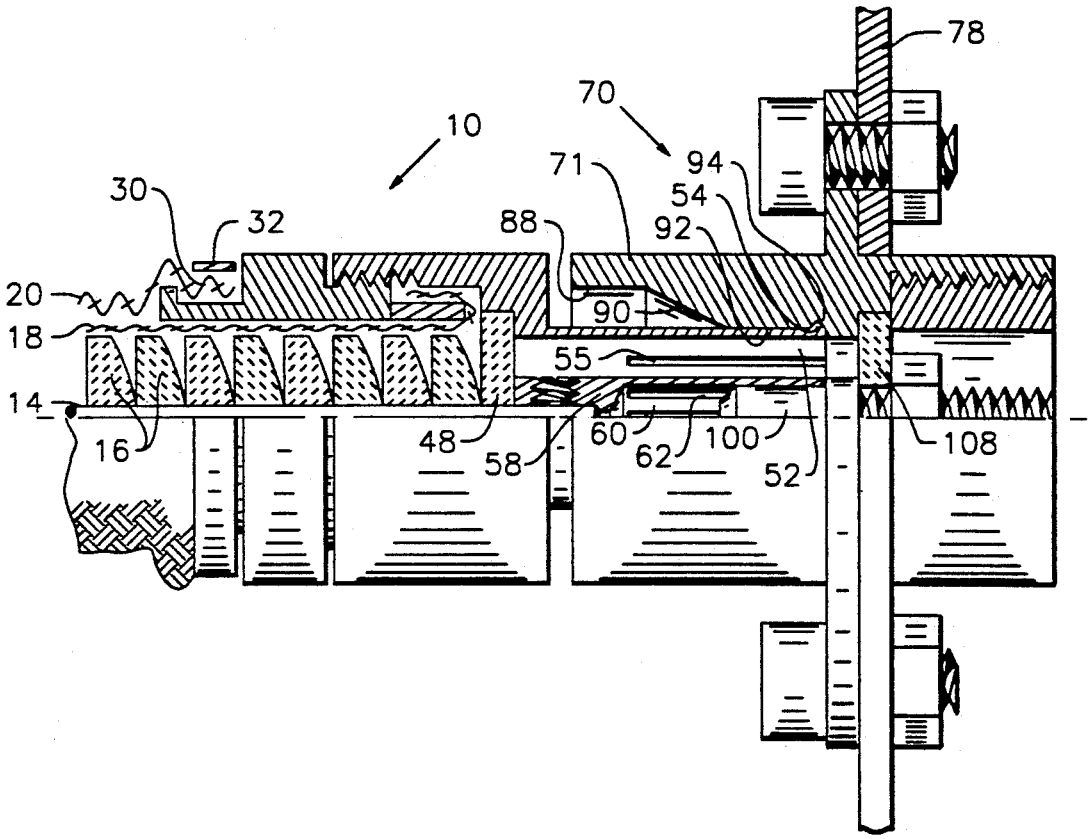

FIG. 2*a* is a fragmentary isometric view of the cable termination of FIG. 2;

FIG. 3 is a generally schematic fragmentary view of a cable shown in FIG. 2 but exhibiting a flexed-shape;

FIG. 4 is a bulkhead fitting, partially broken away and partly schematic, which mates with the cable termination of FIG. 2; and FIG. 5 depicts a side elevational view of a cable termination like that of FIG. 2 mated with a bulkhead fitting like that in FIG. 4.

In FIG. 2 a connector 10 serves as a termination for a coaxial cable 12 to one end of which connector 10 is secured. Cable 12 includes a central inner conductor 14 which is flexible and in this case preferably solid so as to be formed as a single wire. Mounted on conductor 14 are a succession of ceramic beads 16 around the outer circumferences of which are carried a woven metal braid 18. Ensleeving braid 18 is an outer woven ceramic or fiberglass cover 20.

Connector 10 has a barrel 22 formed to have a rearmost collar 24 defining one end of an outwardly-facing recess 26. At its forward end, barrel 22 is necked down and outwardly threaded as at 28. On installation, barrel 22 is slipped over the free end of braid 18 and then beneath the free end of cover 20 after which that cover end portion 30 is clamped into recess 26 by a retaining band 32.

Further included in connector 10 is a cylinder 34 open at its rear end and interiorally threaded at 36 over its rear end portion to threadably engage over threads 28 on barrel 22. Beyond threads 36 toward its forward end, the inner wall of cylinder 34 is first necked down to define a step 40 still further forwardly of which cylinder 34 is necked down still more to define a step 42. Upon mounting cylinder 34 to barrel 22, the free end portion 44 of braid 18 is bent around and over a retaining ring 46 so as to be crimped into contact with cylinder 34. A cylindrical end insulator 48 together with beads 16 maintain an electrical separation between conductor 14 and braid 18.

The innermost end wall of cylinder 34, in-turned to define step 42, integrally projects outwardly from cylinder 34 as a tube 50. Over a predominate portion of its length tube 50 is longitudinally serrated to define a plurality of circumferentially-spaced flexible fingers 52 each of which terminates in an outwardly facing protrusion 54. Tube 50 with its fingers 52 forms an outer male connecting element. Fingers 52 are circumferentially-spaced by respective slots or serrations 55.

Secured by a set screw 56 on the free end portion of conductor 14 just beyond disc-shaped insulator 48 is a centrally bored boss 58 from which integrally project flexible fingers 60 circumferentially-spaced by respective slots or serrations 62. Fingers 60 together form an inner female connecting element.

In order to be able to vent gas trapped within the cable without permitting a surrounding plasma from entering into the cable, by the presence of electrons and ions which tend to cause electrical breakdown, these slots or serrations 55 between the different ones of fingers 52 are carefully formed to be sufficiently narrow that they are of a size less than the Debye distance which may be calculated from equation (1) set forth hereinabove. As noted before for a grounded shield, the exclusion of a plasma of 1015 electrons/meter$^3$, which is more dense than the plasma in the usual vacuum environment, requires that these slots or serrations have a width equal to or less than about 0.25 mm.

For transmission of a radiofrequency current, it is desirable to use a cable in connection with terminations which exhibit a constant impedance. The impedance $Z_0$ is given by $$Z_0=(60/\epsilon_r^{\frac{1}{2}})\ \ln\ (r_o/r_i), \qquad (2)$$

where $\epsilon_r$ is the relative dielectric constant ($\epsilon_r$ is unity for air or vacuum), and $r_i$ and $r_o$ are the inner and outer radii of the dielectric. With $\epsilon_r$ substantially greater than unity for insulators suitable for a vacuum environment, the radius ratio $r_o/r_i$ with these insulators must be considerably greater than the same ratio for a vacuum if the impedance is to be the same. In the illustrated embodiment, a larger value of $r_i$ is used at the connectors than in the cable, with $r_o$ held approximately the same in both locations. So selecting the proper values of radii in the cable and in the connectors, the impedance $Z_o$ can be made constant throughout the cable and termination.

As illustrated, ceramic beads 16 as shown in longitudinal cross section have one side face which is planar and disposed perpendicularly to inner conductor 14 while the opposite face is convex in cross section so as to be outwardly spherical in the overall. As is readily apparent from observation of FIG. 3, that particular bead shape is conducive to cable flexibility. In addition, it is significant to note that beads 16 are shaped in a manner by means of which there is defined an increasing gap between the beads as the distance from inner conductor 14 is increased. It is that form of gap which permits the central conductor to be flexed into a curved shape. However, a variety of other bead shapes may be used for the facing bead surfaces which provide a gap between the beads that generally increases from touching at or near the inner conductor to a wide space at the outer conductor. However, that increasing width need not be linear or smooth.

On the other hand, small departures from alignment between one bead 16 and the next will result in only small departures from the impedance of an aligned configuration because, as is well known, departures from linear solutions involving high order terms do not result in a large departure from the calculated impedence. The gaps between the beads are especially useful in forming channels for enclosed gases to escape, an escape which is further permitted by apertures in braid 18 as well as openings in woven outer covering 20. As also is known, as such, the thickness of beads 16 should be much smaller than the wavelength of any alternating radio wave being transmitted by the cable in order that the voltage standing wave ratio be minimized.

A mating connector 70 is shown in FIG. 4 and for purposes of illustration is in the form of a bulkhead fitting. Connector 70 has a barrel-shaped portion 71 with a forward portion 72 and a rearward portion 74. Intermediate the length of barrel 71 is an outwardly projecting flange 75. The outside diameter of barrel 71 is chosen to fit within an opening 76 through a bulkhead 78. Circumferentially-spaced holes 80 in flange 75 align with a like series of holes 82 in bulkhead 78 so as to permit barrel 71 to be mounted to bulkhead 78 by means of a corresponding series of bolts 84 and nuts 86.

Beginning from forward portion 72, the interior wall of barrel 71 has a first portion 88 of maximum diameter followed by a second portion 90 which tapers inwardly to the lesser diameter of a central portion 92. At the innermost end of portion 92 is a circumferential recess 94 formed outwardly into the body of barrel 71 and beyond which is a slightly more narrow middle portion 96. Continuing from portion 96 toward rear end 74, the inner wall diameter defines a laterally outward step 98 followed by an interiorally threaded and larger final portion 99.

Disposed centrally within barrel 71 is a rod 100 the free end of which projects toward end 72 and is beveled around its periphery. Projecting radially from and integrally projecting outwardly around rod 100 is a collar 102 spaced from the forward beveled end of rod 100 and aligned within middle surface 96 of barrel 71. Continuing to the rear beyond collar 102, rod 100 is threaded as at 104 to receive a nut 106. An annular insulator 108 seated around its periphery in step 98 is clamped by nut 106 against collar 102 to hold rod 100 securely in centered position when an exteriorly threaded plug 110 is screwed into threaded portion 99 against insulator 108.

Central inner surface 92 serves in use as the outer female connective element, and rod 100 serves as the inner male connective element with the two elements separated by insulator 108. Forming connector 70 so as to serve as a bulkhead fitting is only illustrative of any of several different connector possibilities. It may be located in a piece of hardware that is enclosed within a vacuum chamber, and a connection to or an extension of inner male connector 100 can supply direct or alternating current to some electrode in that hardware. Alternatively, the bulkhead fitting could be secured into a vacuum wall, in which case known techniques for vacuum sealing between the connective elements 71 and 100 and the insulator, and between flange 75 and bulkhead 78, would be necessitated.

Instead of fitting in an opening, the connective element formation can provide surface 92 and rod 100 as basically occupying the left half of fitting 70 as shown in FIG. 4 and the fitting may be formed in its right hand portion in a manner to mount on the terminating end of a length of the coaxial cable illustrated. That is, internally threaded portion 99 leading to end 74 of connector 70 would correspond to threaded portion 36 of the assembly of FIG. 2 and be associated with a barrel similar to barrel 22 previously discussed so as to provide the basis for a like attachment onto the cable. Similarly, the cable termination fitting of FIG. 2 could be modified over its rear portion so as to serve as a bulkhead fitting. In any version, the location of the rod 100 as the male inner element could be switched with female inner element 58 having fingers 60, as between connectors 10 and 70.

In FIG. 5, the two assemblies shown in FIGS. 2 and 4 are assembled together so as to mate all of the connecting elements. Protrusions 54 on male outer connector fingers 52 seat into recess 94 in the female outer connector surface 92. Slots 62 between inner female connector fingers 60 permit gas to escape that would otherwise be trapped by that inner connective element 58. In like manner, slots 55 between flexible fingers 52 of the outer male connector permit the escape of gas that would otherwise be trapped by outer female connector surface 92 and insulators 48 and 108.

In particular, slots 55 between outer male connector fingers 52 are sized to preclude entry of any surrounding plasma which will be the case as long as the plasma is of low enough density for the Debye length of equation (1) to equal or exceed the width of slots 55. Thus, slots 55 perform the dual function of forming the flexible fingers of the outer male connector to ensure electrical contact while at the same time precluding the surrounding plasma from entering the inside of the assembled termination and fitting.

Also of particular interest is the entrance shape of barrel 70. It is larger in diameter at first portion 88 than the diameter of fingers 52 of the male connector. That enlarged portion along with tapered portion 90 serves a first function of guiding outer male connector fingers 52 into correct alignment with female connector surface 92 during assembly. After assembly, an escape path for gases passing through slots 55 is thereby created. Moreover, that enlarged portion which includes interior surfaces 88 and 90 overhangs and extends beyond slots 55 so as to sputter-shield externally produced sputtered particles that otherwise could enter slots 55 and degrade the electrical performance of insulators 48 and 108 as well as degrade the conducting surfaces on the inside of the outer connector elements and on the outside of the inner connecting elements. Of course, surface degradation would be particularly serious at high frequencies wherein by skin effect the currents tend to flow more on the surfaces of conductive elements.

As mentioned above, the shape of the ceramic beads also is of particular interest in providing the dual function of cable flexibility and, together with the openings or apertures in surrounding braid 18 and cover 20, facilitate the escape of gas that otherwise would be trapped between the beads. At the same time, those openings or apertures in braid 18 and cover 20 are equal to or less than the plasma Debye length so as to be sufficiently small to preclude the passage of the plasma into the cable interior. Impingement of neutral particles on the metal braid and enclosed ceramic beads is also prevented by outer cover 20 and cover end portion 30 which is held in place by retaining band 32.

Using the principles of construction shown in and described with respect to FIGS. 2, 3, 4 and 5, a 50-ohm coaxial vacuum cable was fabricated. The outside diameter of beads 16 was about fourteen mm while the inside or hole diameter was about two mm. The cable performed successfully at direct-current voltages up to 1000 V while handling an RF power up to 1 kW at 13.56 MHz in frequency. Despite repeated rapid pumpdowns of roughly fifteen minutes from atmospheric pressure to high vacuum, no electrical breakdowns were encountered.

While a particular embodiment of the present invention has been shown and described, and various alternatives and modifications have been taught, it will be obvious to those skilled in the art that changes and modifications may be made without departing from the invention in its broader aspects. Therefore, the aim in the appended claims is to cover all such changes and modifications as fall within the true spirit and scope of that which is patentable.

We claim:

1. A coaxial cable used in a vacuum environment in which is contained a plasma that exhibits a predetermined Debye length, comprising:

an elongated flexible electrically conductive inner wire;

a plurality of electrically-insulative beads having a central opening through which said wire is slidable with said beads being mounted successively in series along said wire and with each of said beads individually having an exterior shape such that, when so mounted, a gap exists between each adjacent pair of said beads with said gap generally increasing in width in the direction radially outward from said inner wire;

and an electrically-conductive flexible braid ensleeving said plurality of beads with said braid being woven from wire strands sufficiently tightly to have interstices ventive of air but of a size no larger than said Debye length to preclude passage of said plasma.

2. A cable as defined in claim 1 which further includes an electrically-insulative flexible covering ensleeving said braid with said covering being woven from threads sufficiently tightly to have interstices ventive of air but of a size no larger than said Debye length to preclude passage of said plasma.

3. A coaxial cable used in a vacuum environment in which is contained a plasma that exhibits a predetermined Debye length, comprising:

an elongated flexible electrically-conductive inner wire;

a plurality of electrically insulative beads having a central opening through which said wire is slidable with said beads being mounted successively in series along said wire and with each of said beads individually having an exterior shape such that, when so mounted, a gap exists between each adjacent pair of said beads with said gap generally increasing in width in the direction radially outward from said inner wire;

and an electrical-conductive flexible layer ensleeving said plurality of beads with said layer having a plurality of apertures ventive of air but of a size no larger than said Debye length to preclude passage of said plasma.

4. A cable as defined in claim 3 which further includes an electrically-insulative flexible covering ensleeving said layer with said covering having a plurality of openings ventive of air but of a size no larger than said Debye length to preclude passage of said plasma.

5. A connector assembly for a coaxial cable used in a vacuum environment in which is contained a plasma that exhibits a predetermined Debye length and having an inner electrical conductor and an outer electrical conductor separated from said inner conductor by an electrically-insulative spacer, comprising:

an electrically-conductive termination having a barrel-shaped body open at one end to fit over an end portion of said cable with said body being electrically and mechanically connectable to said outer conductor;

an outer cylindrical hollow electrical connector element projecting axially outward form the other end of said body with said element having longitudinal slots that define a circumferentially-spaced series of flexible fingers with said slots being ventive of air but of a size no larger than said Debye length to preclude passage of said plasma;

an inner electrical connector element electrically and mechanically connectible to said inner conductor and projecting outwardly beyond said body and spaced inside said outer connector element;

said a mating connective fitting defining an interiorly located circumferential seat connectively receptive of said outer connector element fingers with said fitting also having an inner connective element spaced inwardly from said seat and electrically engageable with said inner connector element.

6. An assembly as defined in claim 5 in which said inner connector element is removably affixed on a free-end portion of said inner conductor and continues axially outwardly as a circumferentially-spaced series of flexible fingers.

7. An assembly as defined in claim 6 in which all spaces between adjacent ones of said fingers of said inner element are ventive of air but are of a size no larger than said Debye length to preclude the passage of a plasma.

8. A connector assembly for a coaxial cable having an inner electrical conductor and an outer electrical conductor separated from said inner conductor by an electrically-insulative spacer, comprising:

an electrically-conductive termination having a barrel-shaped body open at one end to fit over an end portion of said cable with said body being electrically and mechanically connectible to said outer conductor;

an outer cylindrical hollow electrical connector element projecting axially outward from the other end of said body with said element having longitudinal slots that define a circumferentially-spaced series of flexible fingers with said slots being ventive of air but of a size sufficiently small to preclude passage of a plasma;

an inner electrical connector element electrically and mechanically connectible to said inner conductor and projecting outwardly beyond said body and spaced inside said outer connector element;

a mating connective fitting defining an interiorly located circumferential seat connectively receptive of said outer connector element fingers with said fitting also having an inner connective element spaced inwardly from said seat and electrically engageable with said inner connector element;

and in which a cylindrical overhang projects axially beyond one of said body and said fitting in a position radially overlying but spaced from the entire length of said slots exposed outside of said circumferential seat with said overhang axially spaced from the other of said body and said fitting sufficiently to vent air.

9. An assembly as defined in claim 8 in which said overhang projects beyond said seat and includes an interior wall which tapers radially outward from said seat toward said body.

10. An assembly as defined in claim 5 in which a radially-outward protrusion is formed on the free end of each of said outer connector element fingers and a radially-outward recess is defined on the axially inner end of said seat to receive said protrusions.

11. A coaxial cable assembly used in a vacuum environment in which is contained a plasma that exhibits a predetermined Debye length, comprising:

an elongated flexible electrically-conductive inner wire;

a plurality of electrically-insulative beads having a central opening through which said wire is slidable with said beads being mounted successively in series along said wire and with each of said beads individually having an exterior shape such that, when so mounted, a gap exists between each adjacent pair of said beads with said gap generally increasing in width in the direction radially outward from said inner wire;

an electrically-conductive flexible layer ensleeving said plurality of beads with said layer having a plurality of beads with said layer having a plurality of apertures ventive of air but of a size no larger than said Debye length to preclude passage of a plasma;

an electrically-conductive termination having a barrel-shaped body open at one end to fit over an end portion of said flexible layer with said body being electrically and mechanically connectible to said layer;

an outer cylindrical hollow electrical connector element projecting axially outward form the other end of said body with said element having longitudinal slots that define a circumferentially-spaced series of flexible fingers with said slots being ventive of air but of a size no larger than said Debye length to preclude passage of a plasma;

an inner electrical connector element electrically and mechanically connectible to said inner wire and projecting outwardly beyond said body and spaced inside said outer connector element;

and a mating connective fitting defining an interiorly located circumferential seat connectively receptive of said outer connector element fingers with said fitting also having an inner connective element spaced inwardly from said seat and electrically engageable with said inner connector element.

* * * * *

UNITED STATES PATENT AND TRADEMARK OFFICE

CERTIFICATE OF CORRECTION

PATENT NO. : 5,154,635

DATED : October 13, 1992

INVENTOR(S) : Harold R. Kaufman, et al

It is certified that error appears in the above-indentified patent and that said Letters Patent is hereby corrected as shown below:

Column 3, between lines 60 and 61 there should be inserted -- invention, a coaxial cable includes an elongated --.

Column 5, line 43: "1015" should read -- $10^{15}$ --.

Column 10, lines 42 and 43: "having a plurality of beads with said layer" should be deleted.

Column 10, line 54 (actual count): "form" should read -- from --.

Signed and Sealed this

Second Day of November, 1993

Bruce Lehman

*Attest:*

BRUCE LEHMAN

*Attesting Officer*

*Commissioner of Patents and Trademarks*